United States Patent [19]

Jayne

[11] 4,047,785

[45] Sept. 13, 1977

[54] ELECTRICAL CONNECTOR, ASSEMBLY, AND CONTACT

[75] Inventor: Max Leroy Jayne, North Warren, Pa.

[73] Assignee: GTE Sylvania Incorporated, Stamford, Conn.

[21] Appl. No.: 640,257

[22] Filed: Dec. 12, 1975

[51] Int. Cl.[2] ..... H01R 13/38

[52] U.S. Cl. ..... 339/99 R; 339/103 M

[58] Field of Search ..... 339/97-99, 339/103

[56] References Cited

U.S. PATENT DOCUMENTS

| | | | |
|---|---|---|---|
| 1,956,019 | 4/1934 | Gilbert | 339/97 R |
| 3,622,943 | 11/1971 | Reimer | 339/103 M |
| 3,657,682 | 4/1972 | Iversen | 339/103 M |
| 3,824,530 | 7/1974 | Roberts et al. | 339/99 R |
| 3,860,318 | 1/1975 | Reavis, Jr. et al. | 339/99 R |
| 3,867,005 | 2/1975 | Hoppe, Jr. | 339/98 |
| 3,920,306 | 11/1975 | Barnett, Jr. et al. | 339/103 M |

FOREIGN PATENT DOCUMENTS

| | | | |
|---|---|---|---|
| 1,640,630 | 10/1969 | Germany | 339/97 R |

*Primary Examiner*—Joseph H. McGlynn
*Attorney, Agent, or Firm*—Norman J. O'Malley; John C. Fox; Donald R. Castle

[57] ABSTRACT

An electrical connector, assembly, and contact are described which provide for electrical interconnection between at least one electrical wire and a corresponding male pin. The connector features a separable cover means which slidably engages the connector's insulative housing to cover the wire in addition to defining an opening for receiving said wire. The contact is adapted for being positioned within the housing and features a slotted end portion for electrically engaging the wire and an opposing end portion for slidably engaging the male pin.

33 Claims, 11 Drawing Figures

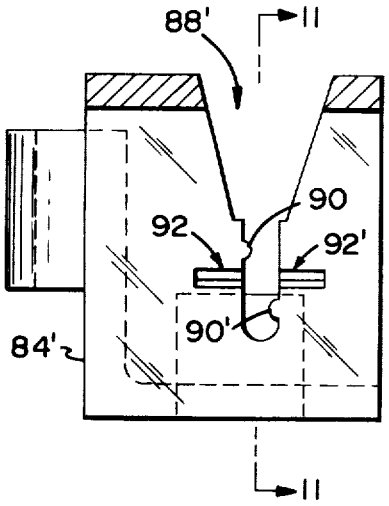
Fig. 9
Fig. 10
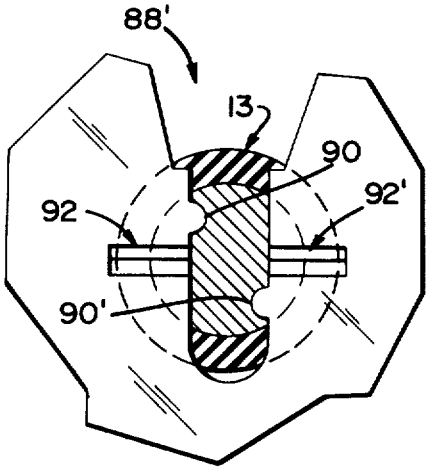
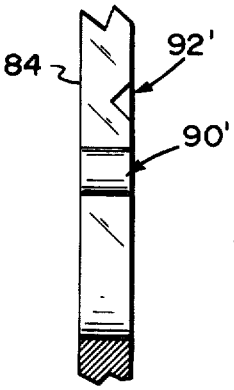
Fig. 11

ELECTRICAL CONNECTOR, ASSEMBLY, AND CONTACT

BACKGROUND OF THE INVENTION

The invention relates to the electrical connector art. The invention further relates to electrical contacts for utilization in the connector art. Even more specifically, the invention relates to electrical connectors and contacts for providing electrical connection between a wire and a corresponding male pin.

A particular use for connectors of the nature described is in the telephone switching field. It is often customary in telephone switching equipment to provide for electrical interconnection between at least one electrical wire having insulation thereabout and at least one male pin securedly positioned within an insulative body. Most usually, it is necessary to electrically connect several of such wires with a corresponding plurality of pins wherein the pins are positioned in rows in an insulative body known in the art as a terminal block.

Heretofore, such assemblies have required connectors of relatively complex design. These assemblies further required several individual manual operations in order to satisfactorily provide the desired interconnections. Additionally, because complex designs were required for the housings, covers, etc for each assembly, repair and disassembly proved both time-comsuming and expensive by manufacturing standards. Another particular problem relating to these members was the lack of an efficient and effective means for electrically engaging the wire. Such wires are well known as including a quantity of insulation thereout, thus necessitating removal or separation of the insulation in order to provide the proper connection. One of the best known methods for removing the insulation has been manual stripping and thereafter placement of the base conducting portion within the connector. This requirement further added to manufacturing costs.

Still another problem of the above described assemblies related to the testing of the connections. The prior art assemblies usually required either partial or complete disassembly of the devices to achieve such testing.

It is believed therefore that an electrical connector assembly, connector, and contact for use therein which would overcome the above mentioned disadvantages of known prior art assemblies would constitute an advancement in the art.

OBJECTS AND SUMMARY OF THE INVENTION

It is therefore a primary object of the present invention to enhance the electrical connector assembly art.

It is a further object of the invention to obviate the disadvantages of known prior art connector assemblies, connectors, and contacts.

In accordance with one aspect of this invention there is provided a connector for electrically interconnecting at least one electrical wire and at least one electrically conductive male pin. The connector comprises an electrically insulative housing having at least one open portion therein, at least one electrical contact substantially positioned with said open portion of said housing and having a slotted first end for engaging said wire and a second opposing end for engaging said male pin, and a separable cover means for being slidably positioned on said housing.

In accordance with another aspect of this invention there is provided a connector assembly which comprises an electrical wire, a conductive male pin positioned within a base member, and a connector for electrically interconnecting said pin and wire. The connector includes at least one electrical contact therein having a first end for engaging said wire and a second opposing end for engaging said male pin and further includes a separable cover for being slidably attached to the connector's housing.

In accordance with still another aspect of the invention there is provided an electrical contact for being positioned within an open portion of an electrically insulative housing. The contact as described comprises a slotted first end portion for positively retaining and electrically engaging an electrical wire and a second opposing end portion for slidably and electrically engaging a male pin.

BRIEF DESCRIPTION OF THE DRAWINGS

FIG. 9 is an elevational view of a preferred embodiment for one of the leg members of the slotted end portion of the invention's contact;

FIG. 10 is an elevational view of the leg member of FIG. 9 having an electrical wire positioned therein; and FIG. 11 is a side elevational view as taken along the line 11—11 in FIG. 9.

DETAILED DESCRIPTION OF THE PREFERRED EMBODIMENTS

For a better understanding of the present invention, together with other and further objects, advantages and capabilities thereof, reference is made to the following disclosure and appended claims in connection with the description of the above drawings of the invention.

Figure 1:
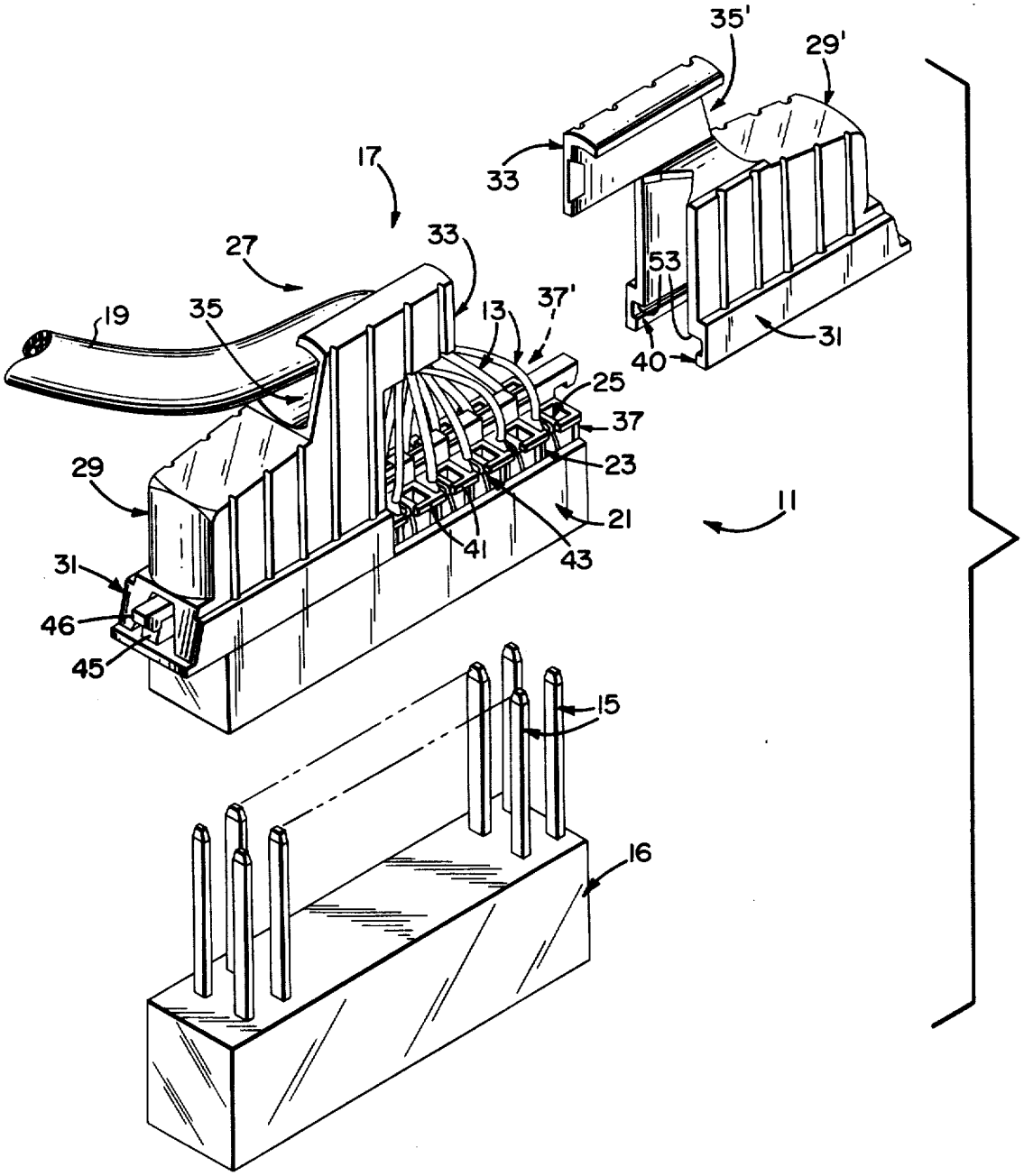
FIG. 1 is an exploded isometric view of a connector assembly in accordance with a preferred embodiment of the invention.

With particular reference to FIG. 1, there is shown an electrical connector assembly 11 in accordance with a preferred embodiment of the invention. As shown, assembly 11 comprises at least one electrical wire 13, at least one electrically conductive male pin 15 positioned within an insulative base 16 and extending therefrom, and a connector 17 for electrically interconnecting wire 13 and male pin 15. Assembly 11 as illustrated is adapted for electrically interconnecting a plurality of individual wires 13 to a corresponding plurality of individual upstanding male pins 15 mounted within a common insulative-base 16. It is understood, however, that in the broad aspects of the present invention, the connector assembly 11 as illustrated could simply provide interconnection between a single wire and corresponding pin. A particular use for assembly 11 is in the telephone switching art. It is common in this art to provide connections between several separate wires and corresponding pins for purposes well known. With particular regard to the present invention, connector assembly 11 is adapted for interconnecting a total of twenty individual wires with a corresponding number of individual male pins.

Each of the described individual wires 13 are encapsulated within a singular sheath 19 to faciliatate handling procedures. Wires 13, as will be described, each comprise an electrically conductive lead portion and an insulative covering thereon. Accordingly, each of the male pins 15 are spacedly positioned within insulative block 16 and include means for eventual electrical connection to external circuitry (not shown). Still further, each of the individual wires 13 encased within sheath 19 are adapted for being eventually connected to a circuit separate from that joined to pins 15. A good example of such circuitry may be another connector substantially similar to that of connector 17. Accordingly, the present invention provides means for electrically interconnecting a plurality of individual circuits typically found in the telephone switching art. As will be described, the present invention provides a more facile means for providing said connections than connector assemblies heretofore known in the art.

Connector 17 comprises an electrically insulative housing 21 including at least one open portion 23 therein. Positioned substantially within open portion 23 of housing 21 is at least one electrical contact 25. As will be described, contact 25 is adapted for positively retaining and electrically engaging a corresponding wire 13 and a corresponding male pin 15 once connector assembly 11 is assembled.

As further illustrated in FIG. 1, connector 17 comprises a separable cover means 27 adapted for being positioned on housing 21 to substantially cover the wire 13 positioned within the connector. Separable cover means 27 in turn comprises at least two cover members 29 and 29' which in turn each include a base portion 31 adapted for slidably engaging housing 21. Additionally, each cover member includes an extending portion 33 which serves to define an opening 35 for receiving wire 13 when the cover members 29 and 29' are fully positioned on housing 21. It can readily be seen in the drawing that openings 35 and 35' provide a means whereby sheath 19 may be positioned within cover means 27 in either of two directions. That is, separable cover members 29 and 29' define two openings, the first being opening 35 and the second 35' opposedly positioned therefrom. In the simplest form of the invention, however, it is understood that the openings 35 and 35' could accommodate but a single wire 13 should it only be desired to electrically interconnect a single wire with a corresponding pin. It is the function of the separable cover means to substantially cover all of the chosen number of wires to be secured within connector 17.

To accommodate each of the separable cover members 29 and 29', housing 21 is provided with a pair of opposingly positioned grooves 37 and 37' (groove 37' is similar to groove 37 and positioned on an opposing side of housing 21). Accordingly, each of the cover members 29 is provided with a pair of extending rib members 40 which in turn are adapted for being slidably positioned within one of the grooves 37 and 37' during positioning of the cover member on housing 21.

Figure 2:
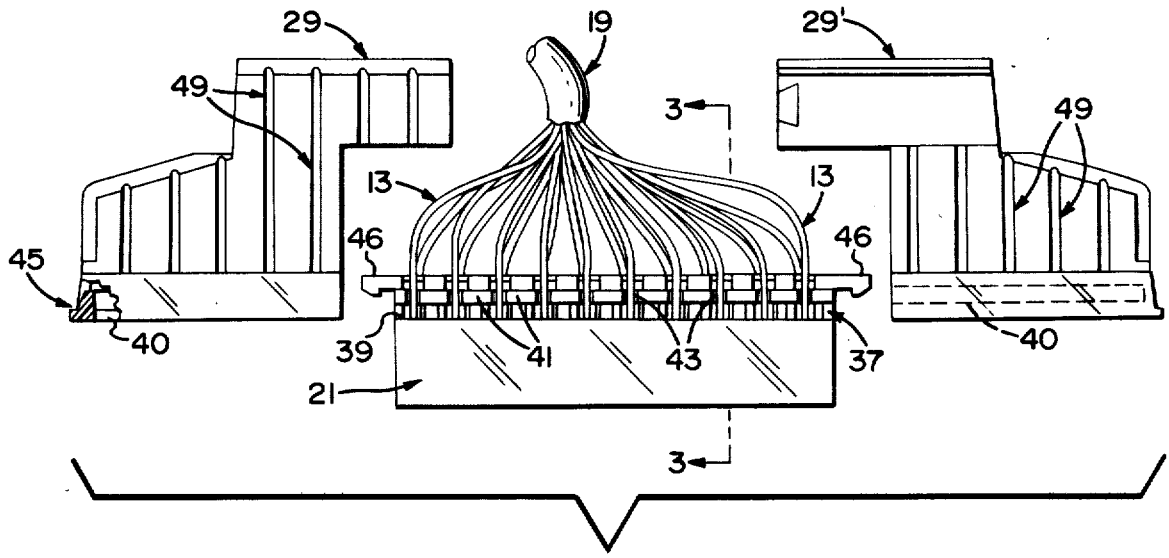
FIG. 2 represents a side elevational view of an electrical connector in accordance with one embodiment of the invention.

This positioning relationship is also illustrated in FIG. 2. As shown therein, each of the separable cover members 29 and 29' are shown as not being positioned on housing 21. Accordingly, FIG. 2 more clearly represents the positioning relationships of all of the wires 13 to be connected by the present invention. A portion of sheath 19 is also shown. Each of the grooves 37 and 37' extend along the entire length of housing 21 on opposing sides thereof and is defined by a lower wall 39 and a plurality of aligned protective arms 41. With reference back to FIG. 1, protective arms 41 serve to substantially protect the contacts 25 positioned within housing 21. Accordingly, protective arms 41 define a plurality of openings 43 therebetween to facilitate positioning of wires 13 within each of the contact members 25. Further description of this positioning relationship will be provided with the description of FIGS. 3–6.

In FIG. 2, the described rib members 40 are also shown. As mentioned, rib members 40 are slidably positioned within corresponding grooves 37 when the separable cover members 29 and 29' are positioned on the connector's housing.

To positively secure each of the separable cover members 29 and 29' on housing 21, a latching means is provided. This includes providing each of the cover members with an upstanding restrictive member 45 (shown cut-away on member 29) which mates with and is retained by a corresponding catch member 46 located on the ends of housing 21. The latching engagement is shown for cover member 29 in FIG. 1. Removal of the separable cover members is easily accomplished by mere upward displacement of the catch members 46 and thereafter outwardly sliding the respective cover members.

Each of the cover members 29 and 29' is provided with a means 49 whereby electrical testing of the contacts within the housing is possible. As shown in FIG. 2, means 49 comprise a plurality of grooves spacedly located within the cover members and which align in a predetermined manner with each of the correspondng contact locations within housing 21. This relationship is also shown in FIGS. 3–6. As will be described therein, testing is permitted by simple insertion of a testing article, e.g. a small diameter electrically conductive wire, within the grooves provided. It is understood that a testing means is provided for each of the contacts as positioned within assembly 11. Each of the illustrated grooves 49 terminate within the base portion 31 of the respective cover members and define an aperture 51 within said base portion which accordingly aligns with the opening 23 within housing 21. This alignment is of course only provided when the separable cover members are fully positioned on the connector's housing.

Figure 6:
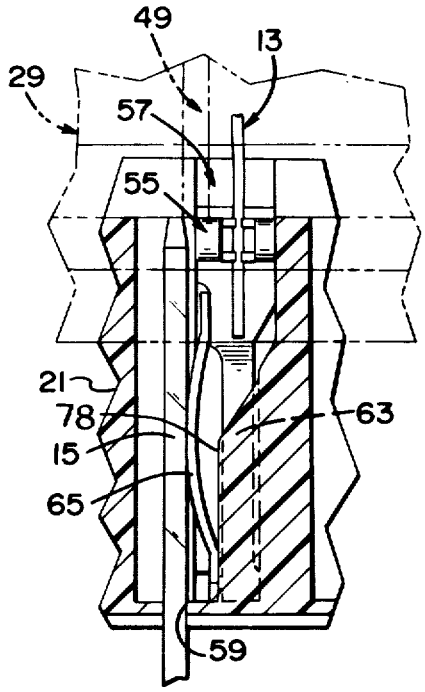
FIG. 6 is a side elevational view, partly in section, as taken along the line 6—6 in FIg. 5.

With reference back to FIG. 1, there is also provided within each of the cover members a means 53 for limiting the insertion of the respective male pins 15 within housing 21. Means 53 comprises an upstanding portion located on the base portion 31 of each of the cover members, said upstanding portion engaging the ends of the male pins 15 during their insertion within housing 21. This limiting means is best shown in FIG. 6 wherein each of the male pins 15 is illustrated as abutting said upstanding portions.

Figure 3:
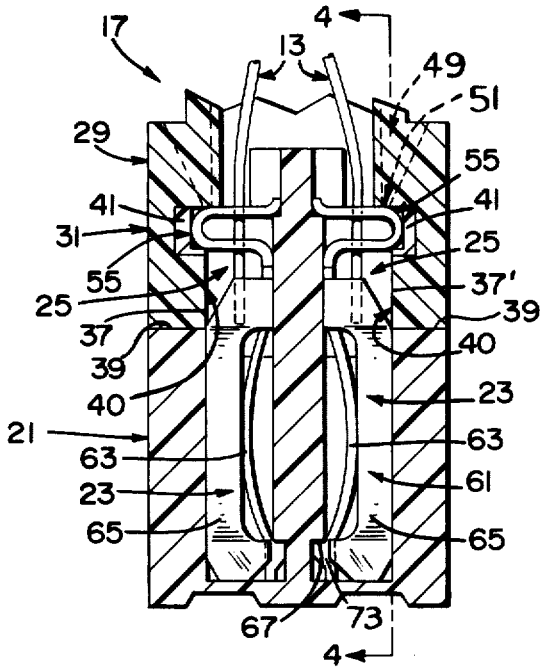
FIG. 3 is an elevational view, partly in section, as taken along the line 3—3 in FIG. 2.

FIG. 3 represents an end elevational view in section of the connector housing 21 and a portion of one of the separable cover members 29. The positioning relationship of two opposingly positioned contacts 25 is also provided. Base portion 31 of cover member 29 is shown as being positioned on housing 21 in the manner previously described. That is, grooves 37 and 37', defined by ledge 39 and protective arms 41 respectively, is shown as being engaged by the extending ribs 40 of base portion 31.

Figure 4:
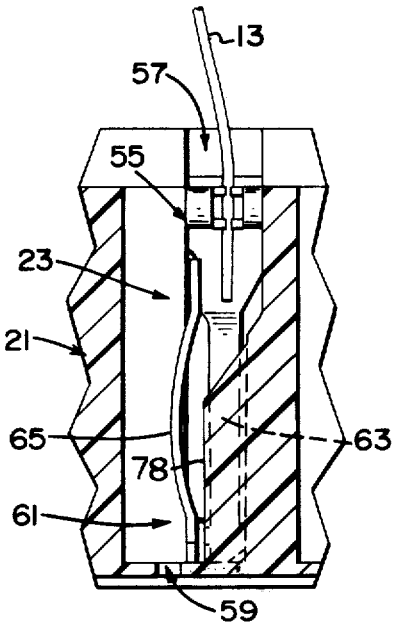
FIG. 4 is a side elevational view, partly in section, as taken along the line 4—4 in FIG. 3.

Wires 13 are also shown as being positioned within connector 17. It can be seen in FIG. 3 that the opposingly positioned electrical contacts 25 each include a slotted first end portion 55 which positively retains and electrically engages the wire 13 when the wire is received within housing 21. Slotted first end 55 is positioned substantially within open portion 23 of housing 21. As better seen in FIG. 4, housing 21 also includes first and second openings 57 and 59 therein. First opening 57 is adapted for receiving wire 13 when the wire is positioned within connector 17. Additionally, second opening 59 is adapted for receiving the male pin (see FIG. 5) when said pin is positioned within the connector. With reference to FIGS. 1, 3 and 4, it can be seen that the slotted first end 55 of contact 25 is positioned relative to first opening 57 to thus facilitate locating and securement of wire 13 within end 55.

Contact 25 is also shown in FIGS. 3 and 4 as comprising a second opposing end portion 61 which in turn is adapted for slidably and electrically engaging the male pin during insertion of the pin within housing 21. Second opposing ends 61 of each of the contacts are therefor positioned relative to openings 59 within housing 21. Second opposing end portion 61 comprises first and second extending arm members 63 and 65 respectively. First extending arm 63 is adapted for positively engaging a wall 67 of open portion 23. Second extending arm 65 is adapted for slidably engaging and making electrical contact with male pin 15 during pin insertion within the housing. With reference to FIG. 6, it can be seen that during insertion of pin 15 within housing 21, the second extending arm 65 will abut first extending arm 63. This form of engagement thus assures a sufficient sliding force against the male pin during its insertion. As shown in FIGS. 4 and 6, this abutment occurs only at the lower ends of each of the respective extending arm members.

Figure 5:
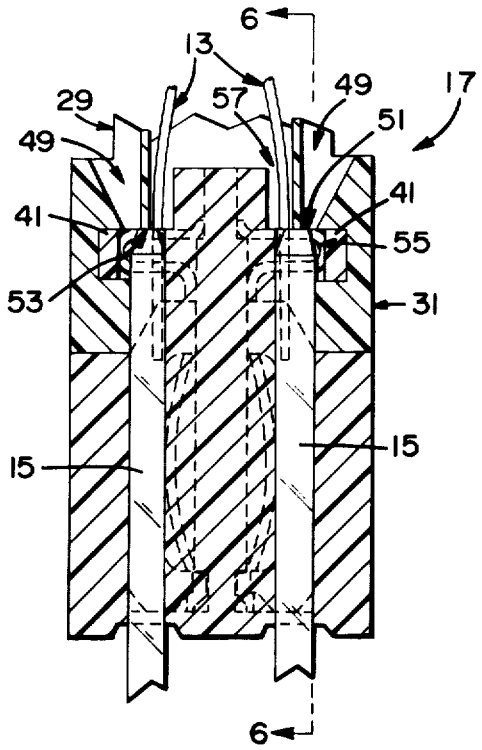
FIG. 5 is an end elevational view, partly in section, of the connector assembly of the invention.

FIGS. 5 and 6 represent the positioning relationships of the components of completely assembled connector 17. That is, the respective male pins 15 have been fully inserted within the connector as well as the corresponding wires 13 positively engaged. It can be seen in FIG. 6 that at no time do the pins and wires physically engage each other. This relationship is accomplished by offsetting the respective openings 57 and 59.

For purposes of clarification, cover member 29 is shown in phantom in FIG. 6. By doing so, the offset positioning relationship of the first and second openings 57 and 59 may be more clearly shown. The previously mentioned means 49 for providing testing of the contact is also shown in FIGS. 5 and 6. These grooves which each eventually define aperture 51 are illustrated as aligning with the slotted first end 55 of contact 25 to permit entry of the previously described testing device.

Figure 7:
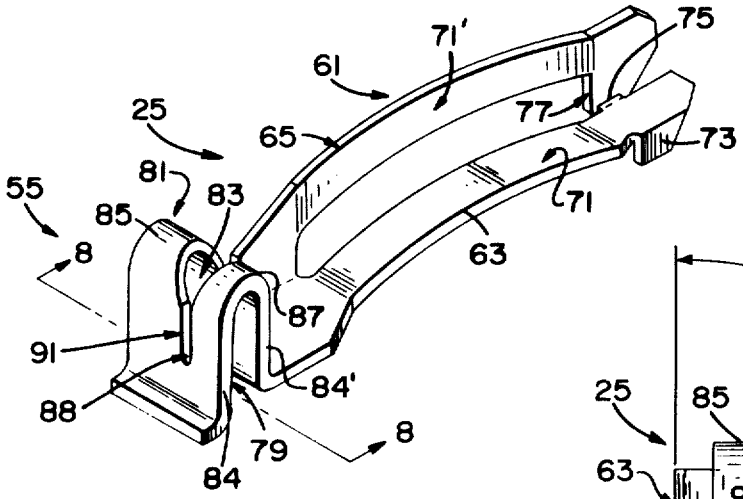
FIG. 7 is an isometric view of a contact in accordance with a preferred embodiment of the invention.

FIG. 7 represents an isometric view of a contact 25 in accordance with a preferred embodiment of the invention. As shown therein, contact 25 comprises a slotted first end portion 55, and a second opposing end 61. First and second extending arm members 63 and 65 of second opposing end portion 61 are also shown in their respective positioning relationships. Each of the arm members 63 and 65 includes a substantially bowed portion 71 and 71' respectively. As described, first extending arm 63 is adapted for positively engaging an inner wall of open portion 23 within connector 21. This positive engagement is achieved by an extending tab 73 located at the end of extending arm 63. This end of arm 63 is also provided with an extending abutting member 75 which in turn is adapted for engaging the corresponding end of arm 65 during the previously described abutting relationship. As mentioned, this abutting relationship occurs only during insertion of the male pin within the housing 21 of connector 17. During this insertion, the bowed portion 71' of second extending arm 65 slidably engages and electrically contacts the pin 15. It can also be seen in FIG. 7 that the end portion of second extending arm 65 is provided with an extending tabular member 77 which also is adapted for abutting an internal wall 78 in FIGS. 4 and 6 of open portion 23. This also facilitates the described abutting relationship.

Figure 8:
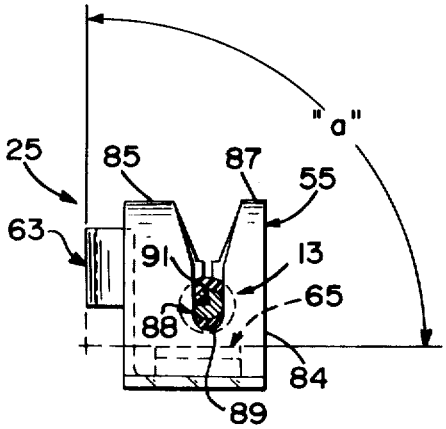
FIG. 8 represents an end elevational view taken along the line 8—8 in FIG. 7 of the contact of FIG. 7 having an electrical wire positively retained therein.

FIG. 8 represents an end view of contact 25 showing the respective positioning of a wire 13 as positively retained within slotted end 55. It can further be seen in FIG. 8 that the extending arms 63 and 65 are positoned at an angle ("a") of about 90° with each other. This is a preferred positioning relationship and is not meant to limit the invention in any manner. With reference to FIGS. 7 and 8, slotted first end 55 comprises an elongated portion 79 which is bent in an established angle transversely of its length to define an upstanding knee portion 81 and a substantially V-shaped portion 83 within knee portion 81. Knee portion 81 includes a pair of upstanding leg members 84 and 84'. As can be seen, V-shaped portion 83 defines the slot into which wire 13 is received within first end 55. The drawings further illustrate that the V-shaped portion 83 is positioned in an offset manner within each of the legs 84 and 84' of upstanding knee 81. It has been determined by positioning the V-slot in said manner, the flexing ability of the upstanding knee during wire insertion is increased. By providing the upstanding knee with a first side 85 substantially larger than opposing second side 87, the tendency of second side 87 to outwardly flex during wire positoning is increased. This outward flexure thus assures a means whereby the conductive portion of the wire is not seriously damaged during retention within contact 25.

As stated, knee portion 81 includes two leg members 84 and 84'. It is preferred in the present invention that slotted opening 83 extend into each of these leg members to define two wire receiving slots 88 and 88' respectively. Receiving slot 88' is hidden in FIGS. 7 and 8 and will be described in detail with the description of FIGS. 9–11. Wire receiving slot 88 (within leg 84) preferably includes at least one relatively sharp edge portion 91 for penetrating and therefor substantially removing the insulative material 89 from about wire 13 during positioning of the wire. It is only necessary that edge 91 remove the insulative material. Accordingly, penetration of the conductive portion of wire 13 is not considered essential at this location.

It is also preferred with regard to the present invention that wire receiving slot 88' within leg member 84' be substantially smaller than corresponding slot 88 in leg 84. This feature of the invention thus provides a means whereby positive penetration of the conductive portion of wire 13 is achieved. With reference to FIG. 9, wire receiving slot 88' includes at least one, and preferably a pair of extending tips 90 and 90' offset in an opposing manner within the slot. At least one of these tips serves to actively penetrate a portion of the wire's conductive portion during positioning of said wire. This is best illustrated in FIG. 10 where wire 13 is shown in positon within slot 88'. To further facilitate conductive penetration, a pair of opposingly positioned scored areas 92 and 92' are provided within leg 84 in the manner illustrated. As shown, each of these areas are at substantially the same depth location within receiving slot 88'. It is also preferred that both scored areas be of a substantially similar cross-sectional V-shape as indicated in FIG. 12. The above preferred feature for slotted first end 55 assures a means whereby both positive retention and electrical connection with wire 13 is achieved. It is understood that only one such scored area could be utilized with the present invention to facilitate the described penetration. However, two such areas are preferred for the reasons stated above.

While there have been shown and described what are at present considered the preferred embodiments of the invention, it will be obvious to those skilled in the art that various changes and modifications may be made therein without departing from the scope of the invention as defined by the appended claims.

I claim:

1. A connector for electrically interconnecting at least one electrical wire having an insulative covering thereon and at least one electrically conductive male pin, said connector comprising:

an electrically insulative housing including at least one open portion therein and first and second openings each having access to said open portion, said fist opening adapted for receiving said electrical wire, said second opening adapted for receiving said male pin when said male pin is inserted within said housing;

at least one electrical contact positioned substantially within said open portion of said housing and having a slotted first end portion for positively retaining and electrically engaging said electrical wire when said wire is received within said first opening of said housing and a second opposing end portion comprising first and second extending arm members each including a substantially bowed portion, said first extending arm member adapted for positively engaging a wall of said open portion within said housing, said second extending arm member adapted for slidably engaging and making electrical contact with said male pin when said male pin is inserted within said housing; and separable cover means for being positioned on said housing to substantially cover said electrical wire within said connector, said cover means comprising at least two cover members each having a base portion for slidably engaging said housing and an extending portion, said extending portions defining an opening for receiving said electrical wire when said cover members are positioned on said housing.

2. The connector according to claim 1 wherein said first arm member is positioned at an angle of about 90° with said second arm member.

3. The connector according to claim 1 further including means within said separable cover means for permitting electrical testing of said contact within said open portion of said housing when said cover members are positioned on said housing.

4. The connector according to claim 3 wherein said means for permitting electrical testing of said contact comprises at least one aperture within said base portion of one of said cover members for aligning with said first opening of said housing when said cover member having said aperture is positioned on said housing.

5. The connector according to claim 1 further including means within at least one of said base portions of said cover members for limiting the insertion of said male pin within said housing.

6. The connector according to claim 5 wherein said means for limiting the insertion of said male pin within said housing comprises an upstanding portion for engaging the end of said male pin.

7. The connector according to claim 1 wherein said housing further includes a pair of opposingly positioned grooves therein, each of said grooves adapted for having said base portion of one of said cover members slide therein.

8. The connector according to claim 7 wherein each of said cover members includes a pair of extending rib members each adapted for being slidably positioned within one of said grooves within said housing.

9. The connector according to claim 1 wherein said slotted first end portion comprises an elongated portion bent at an established angle transversely of its length to define an upstanding knee portion having two leg members, and a substantially V-shaped portion extending within each of said leg members of said upstanding knee portion for defining a wire receiving slot within each of said leg members.

10. The connector according to claim 9 wherein said V-shaped portion is positioned in an offset manner within said leg members of said upstanding knee portion.

11. The connector according to claim 9 wherein one of said wire receiving slots includes at least one edge portion for penetrating the insulative covering on said wire and electrically engaging said wire when said wire is positioned within said slotted first end portion.

12. The connector according to claim 11, wherein the second of said wire receiving slots is substantially smaller than the first receiving slot and includes at least one extending tip member for penetrating the electrically conductive portion of said wire when said wire is positioned within said slotted first end.

13. The connector according to claim 12 wherein said second receiving slot further includes at least one scored area for facilitating said penetration of said conductive portion of said wire.

14. A connector assembly comprising:

at least one electrical wire having an insulative covering thereon;

at least one electrically conductive male pin positioned within an insulative base member and extending therefrom; and a connector for electrically interconnecting said electrical wire and said male pin, said connector comprising an electrically insulative housing including at least one open portion therein and first and second openings each having access to said open portion, said first opening adapted for receiving said electrical wire, said second opening adapted for receiving said male pin when said male pin is inserted within said housing, at least one electrical contact positioned substantially within said open portion of said housing and having a slotted first end portion for positively retaining and electrically engaging said electrical wire when said wire is received within said first opening of said housing and a second opposing end portion comprising first and second extending arm members each including a substantially bowed portion, said first extending arm member adapted for positively engaging a wall of said open portion within said housing, said second extending arm member adapted for slidably engaging and making electrical contact with said male pin when said male pin is inserted within said housing, and separable cover means for being positioned on said housing to substantially cover said electrical wire within said connector, said cover means comprising at least two cover members each having the base portion for slidably engaging said housing and an extending portion, said extending portions defining an opening for receiving said electrical wire when said cover members are positioned on said housing.

15. The connector assembly according to claim 14 wherein said first arm member is positioned at an angle of about 90° with said second arm member.

16. The connector assembly according to claim 14 wherein said connector fruther includes means within said separable cover means for permitting electrical testing of said contact within said open portion of said housing when said cover members are positioned on said housing.

17. The connector assembly according to claim 16 wherein said means for testing said contact comprises at least one aperture within said base portion of one of said cover members of said connector for aligning with said first opening of said housing when said cover member having said aperture is positioned on said housing.

18. The connector assembly according to claim 14 wherein at least one of said base portions of said cover members of said connector further includes means for limiting the insertion of said male pin within said housing.

19. The connector assembly according to claim 18 wherein said means for limiting the insertion of said male pin within said housing of said connector comprises an upstanding portion for engaging the end of said male pin.

20. The connector assembly according to claim 14 wherein said housing of said connector further includes a pair of opposingly positioned grooves therein, each of said grooves adapted for having said base portion of one of said cover members slide therein.

21. The connector assembly according to claim 20 wherein each of said cover members of said connector includes a pair of extending rib members each adapted for being slidably positioned within one of said grooves within said housing.

22. The connector assembly according to claim 14 wherein said slotted first end portion of said contact of said connector comprises an elongated portion bent in an established angle transversely of its length to define an upstanding knee portion having two leg members and a substantially V-shaped portion extending within each of said leg members of said upstanding knee portion for defining a wire receiving slot within each of said leg members.

23. The connector assembly according to claim 22 wherein said V-shaped portion is positioned in an offset manner within said leg members of said upstanding knee portion.

24. The connector assembly according to claim 22 wherein one of said receiving slots includes at least one edge portion for penetrating the insulative covering on said wire and positively engaging said wire when said wire is positioned within said slotted first end portion.

25. The connector assembly according to claim 24 wherein the second of said wire receiving slots is substantially smaller than the first receiving slot and includes at least one extending tip member for penetrating the electrically conductive portion of said wire when said wire is positioned within said slotted first end.

26. The connector assembly according to claim 25 wherein said second receiving slot further includes at least one scored area for facilitating said penetration of said conductive portion of said wire.

27. An electrical contact for being positioned within an open portion of an electrically insulative housing, said contact comprising:

a slotted first end portion for positively retaining and electrically engaging an electrical wire when said wire is received within said open portion of said insulative housing; and a second opposing end portion comprising first and second extending arm members each including a substantially bowed portion, said first arm member adapted for positively engaging a wall of said open portion within said housing, said second extending arm member adapted for slidably engaging and making electrical contact with a male pin when said pin is inserted within said housing.

28. The electrical contact according to claim 27 wherein said first arm member is positioned at an angle of about 90° with said second arm member.

29. The electrical contact according to claim 27 wherein said slotted first end portion comprises an elongated portion bent at an established angle transversely of its length to define an upstanding knee portion having two leg members and a substantially V-shaped portion extending within each of said leg members of said upstanding knee portion for defining a wire receiving slot within each of said leg members.

30. The electrical contact according to claim 29 wherein said V-shaped portion is positioned at an offset manner within said leg members of said upstanding knee portion.

31. The electrical contact according to claim 29 wherein one of said wire receiving slots includes at least one edge portion for penetrating an insulative covering on said electrical wire and electrically engaging said wire when said wire is positioned within said slotted first end portion.

32. The electrical contact according to claim 31 wherein the second of said wire receiving slots is substantially smaller than the first receiving slot and includes at least one extending tip member for penetrating the electrically conductive portion of said wire when said wire is positioned within said slotted first end.

33. The electrical contact according to claim 32 wherein said second receiving slot further includes at least one scored area for facilitating said penetration of said conductive portion of said wire.

* * * * *